US007649318B2

(12) United States Patent
Hur et al.

(10) Patent No.: US 7,649,318 B2
(45) Date of Patent: Jan. 19, 2010

(54) DESIGN FOR A PLASMA DISPLAY PANEL THAT PROVIDES IMPROVED LUMINANCE-EFFICIENCY AND ALLOWS FOR A LOWER VOLTAGE TO INITIATE DISCHARGE

(75) Inventors: Min Hur, Suwon-si (KR); Hoon-Young Choi, Suwon-si (KR); Young-Do Choi, Suwon-si (KR); Takahisa Mizuta, Suwon-si (KR); Yoon-Hyoung Cho, Suwon-si (KR); Hyea-Weon Shin, Suwon-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 690 days.

(21) Appl. No.: 11/165,518

(22) Filed: Jun. 24, 2005

(65) Prior Publication Data

US 2006/0001377 A1 Jan. 5, 2006

(30) Foreign Application Priority Data

Jun. 30, 2004 (KR) ..... 10-2004-0050678
Jun. 30, 2004 (KR) ..... 10-2004-0050679
Jun. 30, 2004 (KR) ..... 10-2004-0050685
Jun. 30, 2004 (KR) ..... 10-2004-0050732

(51) Int. Cl.
*H01J 17/49* (2006.01)

(52) U.S. Cl. ..... 313/585; 313/582

(58) Field of Classification Search ..... None
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa (Continued)

FOREIGN PATENT DOCUMENTS

CN 1315741 A 10/2001

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Toan Ton
*Assistant Examiner*—Britt D Hanley
(74) *Attorney, Agent, or Firm*—Robert E. Bushnell, Esq.

(57) ABSTRACT

A plasma display panel capable of increasing a luminous efficiency while decreasing discharge firing voltage while easily generating an address discharge by generating a sustain discharge as facing discharge. The discharge sustain electrodes are on barrier ribs between the two substrates. One of the sustain discharge electrodes extends between discharge cells and the other extends through discharge cells dividing discharge cells into two portions. Each discharge sustain electrode is surrounded by a dielectric material and also a non-transparent MgO protective layer. These electrodes are formed to be tall and narrow to allow for superior facing discharge potential.

44 Claims, 16 Drawing Sheets

U.S. PATENT DOCUMENTS

| | | | | |
|---|---|---|---|---|
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 6,747,409 | B1 | 6/2004 | Han et al. | |
| 7,170,226 | B2 * | 1/2007 | Su et al. | 313/582 |
| 2004/0245929 | A1 * | 12/2004 | Sakamoto | 313/584 |

FOREIGN PATENT DOCUMENTS

| | | | |
|---|---|---|---|
| CN | 1397978 | A | 2/2003 |
| CN | 1482647 | A | 3/2004 |
| CN | 1495838 | A | 5/2004 |
| JP | 02-148645 | | 6/1990 |
| JP | 08-339766 | | 12/1996 |
| JP | 2845183 | | 10/1998 |
| JP | 2917279 | | 4/1999 |
| JP | 2001-043804 | | 2/2001 |
| JP | 2001-084913 | * | 3/2001 |
| JP | 2001-325888 | | 11/2001 |
| JP | 2002-313240 | A | 10/2002 |
| JP | 2003-151449 | | 5/2003 |
| JP | 2003-208850 | | 7/2003 |
| JP | 2003-208851 | | 7/2003 |
| KR | 1999-0054291 | | 7/1999 |
| KR | 2004-0048607 | | 6/2004 |

* cited by examiner

DESIGN FOR A PLASMA DISPLAY PANEL THAT PROVIDES IMPROVED LUMINANCE-EFFICIENCY AND ALLOWS FOR A LOWER VOLTAGE TO INITIATE DISCHARGE

CLAIM OF PRIORITY

This application makes reference to, incorporates the same herein, and claims all benefits accruing under 35 U.S.C. §119 from my two applications entitled PLASMA DISPLAY PANEL, earlier filed in the Korean Intellectual Property Office on 30 Jun. 2004, and there duly assigned Ser. Nos. 10-2004-0050678, 10-2004-0050679, 10-2004-0050685 and 10-2004-0050732, respectively.

BACKGROUND OF THE INVENTION

1. Field of the Invention

The present invention relates to a plasma display panel (PDP), and more particularly, to a PDP having an electrode structure resulting in a high-density and a high-luminance display.

2. Description of the Related Art

A plasma display panel (PDP) is a display apparatus using plasma discharge. Vacuum ultraviolet (VUV) light emitted by the plasma discharge excites phosphor layers, and in turn, the phosphor layers emit visible light that is used to display images. Recently, the PDP can be implemented as a thin wide screen apparatus having a screen size of 60 inches or more and a thickness of 10 cm or less. In addition, since it is a spontaneous light emitting apparatus such as CRT, the PDP has excellent color reproducibility. In addition, the PDP has no image distortion associated with its viewing angle. Moreover, the PDP can be manufactured by a simpler method than an LCD can, so that the PDP can be produced with a low production cost and a high productivity. Therefore, the PDP is expected to be a next-generation display apparatus for industry and home TVs.

A three electrode type PDP has become very popular recently. However, such a PDP is limited by the fact that it has a limited luminance efficiency and a large voltage is needed to initiate or fire the discharge. Therefore, what is needed is a design for a PDP that results in improved luminance efficiency where a lower voltage is needed to start discharge.

SUMMARY OF THE INVENTION

It is therefore an object of the present invention to provide an improved design for a PDP.

It is also an object of the present invention to provide a design for a PDP that has improved luminance efficiency.

It is still an object of the present invention to provide a design for a PDP that results in a lower voltage to initiate a discharge.

It is yet an object of the present invention is to provide a PDP capable of increasing a luminous efficiency while decreasing a discharge firing voltage and easily generating an address discharge by generating a sustain discharge as a facing discharge.

These and other objects can be achieved by a design for a PDP that includes a first and a second substrate facing each other, a plurality of address electrodes arranged on the first substrate and extending parallel to each other in a first direction, a plurality of barrier ribs comprising first and second barrier rib elements arranged between the first substrate and the second substrate and adapted to partition a plurality of discharge cells, the first barrier rib elements extending in the first direction and the second barrier rib elements extending in a second direction that intersects the first direction, phosphor layers arranged in the discharge cells, a plurality of first electrodes arranged between the first substrate and the second substrate and corresponding to the second barrier rib elements and extending in the second direction, and a plurality of second electrodes arranged between adjacent first electrodes passing through internal spaces of the discharge cells in the second direction.

In the present invention, the first electrodes can be surrounded by a dielectric layer, and transverse cross sections of the first electrode and the second barrier rib elements can have substantially the same central lines. The heights of transverse cross sections of the first electrodes in a direction perpendicular to the substrates can be larger than widths thereof in a direction parallel to the substrates. A protective layer can be formed on at least a side wall of the first electrodes facing the internal spaces of the discharge cells, the protective layer can be non transparent to visible light.

The second electrodes can be surrounded by a dielectric layer, and a thickness of the dielectric layer coated on a bottom surface of each of the second electrodes facing the first substrate can be larger than a thickness of the dielectric layer coated on a side wall of each of the second electrodes facing the first electrode. The heights of transverse cross sections of the second electrodes in a direction perpendicular to the substrates can be larger than widths thereof in a direction parallel to the substrates. A protective layer can be formed to surround at least a surface of the second electrodes exposed to an internal space of the discharge cell, and the protective layer can be non-transparent to visible light. The second electrodes can be located to pass through the first barrier rib elements.

The first and second barrier rib elements can protrude from the first substrate towards the second substrate, third barrier rib elements, having a shape corresponding to the first barrier rib elements, can protrude from the second substrate towards the first substrate, and fourth barrier rib elements, having a shape corresponding to the second barrier rib elements, can protrude from the second substrate towards the first substrate. The first electrodes can be located between the second and fourth barrier rib elements, and the second electrodes can be located between the first and third barrier rib elements. The phosphor layers can be located on regions of the second substrate defined by the third and fourth barrier rib elements.

Address electrodes can include address discharge generation portions located between the first and second electrodes and connection portions electrically connecting the address discharge generation portions. The widths of the connection portions in a direction intersecting the address electrodes can be smaller than widths of the address discharge generation portions in the direction intersecting the address electrodes. The two of the address discharge generation portions can be located in each of the discharge cells. The address discharge generation portions can have a rectangular shape corresponding to a space defined by the first and second electrodes.

The first gaps $\delta$12 can be formed between the address discharge generation portions and the first electrodes, and second gaps $\delta$22 can be formed between the address discharge generation portions and the second electrodes, wherein the first gaps $\delta$12 are larger than the second gaps $\delta$22.

The auxiliary barrier rib elements can be located between the adjacent second barrier rib elements in a direction parallel to the second barrier rib elements, wherein the second electrodes are located corresponding to the auxiliary barrier rib elements to extend in the direction parallel thereto. The phosphor layers can be located on side walls of the auxiliary barrier rib element. The transverse cross sections of the second electrodes and the corresponding auxiliary barrier rib elements can have substantially the same central lines.

The first electrodes can be located between the second and fourth barrier rib elements that face each other, and the second electrode can be located between the auxiliary barrier rib elements and the third barrier rib elements that intersect each other.

The protrusions are provided in at least one of the first and second electrodes in a facing direction of the first and second electrodes respectively. The protrusions can be located on side walls of the first electrodes facing the second electrodes, wherein the protrusions are located at the central positions of transverse cross sections of the first electrodes between the first and second substrates. The first electrodes and the protrusions thereof can be surrounded by a dielectric layer. The protrusions can be located closer to either the first or the second substrate. The protrusions can be located at the central positions of transverse cross sections of the second electrodes between the first and second substrates. The second electrodes and the protrusions thereof can be surrounded by a dielectric layer.

The protrusions can be located on side walls of the first electrodes facing the second electrodes, wherein the second electrodes have protrusions protruding from the second electrodes toward the first electrodes.

The transverse cross sections of the second electrodes can have a rectangular shape, wherein heights of the transverse cross sections of the second electrodes in a direction perpendicular to the substrates are larger than widths thereof in a direction parallel to the substrates, and wherein the first electrodes have protrusions protruding from the first electrodes toward the second electrodes.

The transverse cross sections of the first electrodes can have a rectangular shape, wherein heights of the transverse cross sections of the first electrodes in a direction perpendicular to the substrates are larger than widths thereof in a direction parallel to the substrates, and wherein the second electrodes have protrusions protruding from the second electrodes toward the first electrodes.

The transverse cross sections of the first electrodes can have a rectangular shape, wherein heights of the transverse cross sections of the first electrodes in a direction perpendicular to the substrates are larger than widths thereof in a direction parallel to the substrates, wherein the second electrodes have protrusions protruding from the second electrodes toward the first electrodes, and wherein a dielectric layer surrounding the protrusions protrudes in the protruding direction of the protrusions.

The transverse cross sections of the first electrodes can have a rectangular shape, wherein heights of the transverse cross sections of the first electrodes in a direction perpendicular to the substrates are larger than widths thereof in a direction parallel to the substrates, wherein the second electrodes have protrusions protruding from the second electrodes toward the first electrodes, and wherein the protrusions are located closer to the first substrate.

The transverse cross sections of the first electrodes can have a rectangular shape, wherein heights of the transverse cross sections of the first electrodes in a direction perpendicular to the substrates are larger than widths thereof in a direction parallel to the substrates, wherein the second electrodes have protrusions protruding from the second electrodes toward the first electrodes, and wherein the protrusions are located closer to the second substrate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Since the 1970s, a variety of structures of the PDP have been developed. Recently, a three-electrode surface-discharge type PDP has been widely used. In the three-electrode surface-discharge type PDP, two electrodes including scan and sustain electrodes are located on one substrate, and one address electrode is located on the other substrate in the direction intersecting the scan and sustain electrodes. The two substrates are separated from each other to prepare a discharge space filled with a discharge gas. In general, in the three-electrode surface-discharge type PDP, the selection of individual discharge cells for discharge is determined by an address discharge. Specifically, the address discharge is generated as a facing discharge between the scan electrode controlled separately and the address electrode opposite to the scan electrode, and a sustain discharge related to brightness is generated as a surface discharge between the scan and sustain electrodes located on the same substrate.

The PDP uses a glow discharge to generate visible light. Several steps proceed to generate the visible light from the glow discharge. First, the glow discharge emits electrons, and the electrons collide with a discharge gas, so that the discharge gas becomes excited. Next, ultraviolet (UV) light is emitted from the excited discharge gas. The UV light impacts on phosphor layers in discharge cells, so that the phosphor layers are excited. Next, the visible light is emitted from the excited phosphor layers. The visible light then passes through a transparent substrate where it can be perceived by human eyes. In these series of the steps, a relatively large amount of input energy is lost.

The glow discharge is generated by applying a voltage greater than a discharge firing voltage (i.e., a voltage needed to initiate discharge) between two electrodes at a low pressure (<1 atm). The discharge firing voltage is a function of types of discharge gas, an ambient pressure, and distance between electrodes. In case of an AC glow discharge, in addition to these three variables, the discharge firing voltage depends on the capacitance of a dielectric layer interposed between the two electrodes and a frequency of the applied voltage. The capacitance is a function of a dielectric constant of the dielectric material, an area of the electrode, and a thickness of the dielectric material.

Figure 1:
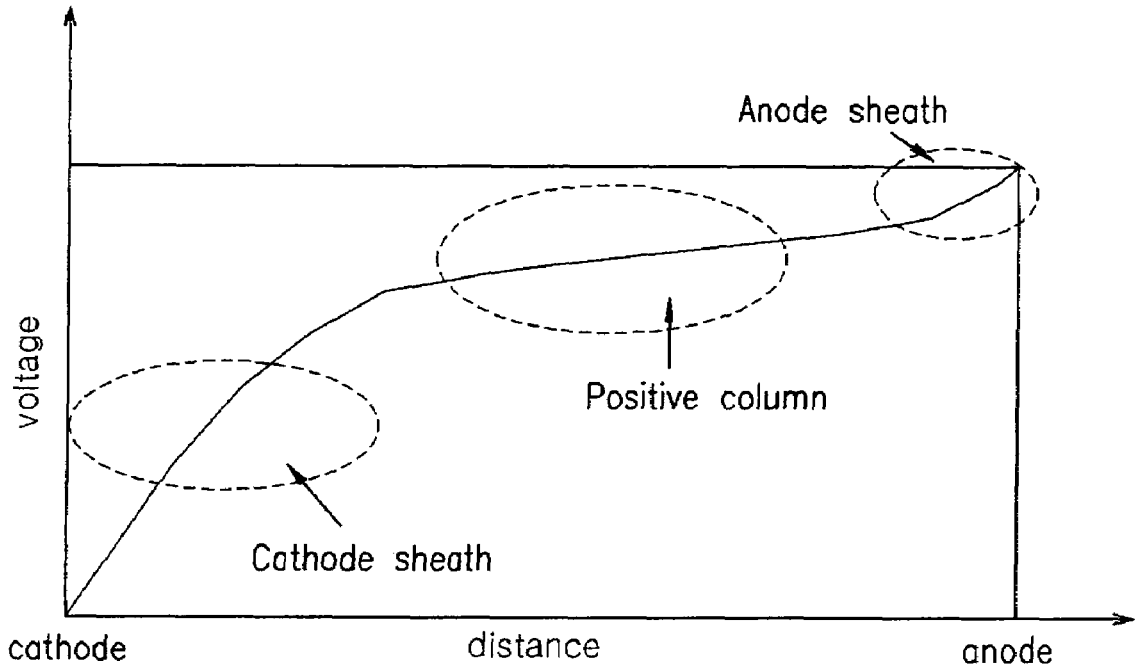
FIG. 1 is a graph schematically illustrating a distribution of voltage applied between anode and cathode in a general glow discharge.

A high voltage needs to be applied in order to fire (or initiate) the glow discharge. Once the discharge is generated, the voltage distribution between anode and cathode illustrates the distorted shape of FIG. 1 due to a difference of space charges generated at anode and cathode sheaths, that is, at regions near the anode and cathode. FIG. 1 illustrates that most of the voltage is used at the anode and cathode sheaths. In addition, FIG. 1 illustrates that a relatively small amount of the voltage is used at a positive column region. In particular, it is known that, in case of the glow discharge of the PDP, the voltage used at the cathode sheath is so far higher than the voltage used at the anode sheath.

The visible light emitted from the phosphor layers originates from the impact of the VUV light on the phosphor layers. Here, the VUV light is generated when an energy state of Xe in the discharge gas changes from its excited state to its ground state. The excited state of Xe is made by collision of the excited electrons with the ground-state Xe. Therefore, in order to increase a luminous efficiency, that is, a ratio of a visible-light-generating energy to the input energy, it is necessary to increase an electron heating efficiency, that is, a ratio of a electron-heating energy to the input energy.

In general, the electron heating efficiency of the positive column region is higher than that of the cathode sheath. Therefore, the luminous efficiency of PDP can be increased by widening the positive column region. In addition, since the sheath has a constant thickness at a given pressure, it is necessary to lengthen a distance of discharge in order to increase the luminous efficiency.

In case of a three-electrode PDP, the discharge is fired or initiated at a central region of discharge cell, that is, the region closest to both of the two electrodes. This is because the discharge firing voltage is low at the central region of the discharge cell. In general, the discharge firing voltage is a function of a product of a pressure and a distance between electrodes. In addition, an operation range of PDP is located at the right of a minimum value in the Paschen curve. Once the discharge is fired, the space charges are generated, so that the discharge can be sustained at a voltage less than the discharge firing voltage. In addition, the voltage between the two electrodes gradually decreases with time. After the discharge is fired, ions and electrons are accumulated on the central region of the discharge cell, so that the electric field is weakened. Finally, the discharge in the region disappears.

The anode and cathode spots move with time toward regions where there is no surface charge, that is, edges of the two electrodes. Since the voltage between the two electrode decreases with time, a strong discharge is generated at the central region of discharge cell (with a low luminous efficiency), and a weak discharge is generated at the edges of the discharge cell (with a high luminous efficiency). Therefore, in the three-electrode PDP, the electron heating efficiency is lowered, so that the luminous efficiency is lowered. In order to overcome the shortcomings of the three-electrode PDP, an approach for lengthening the distance between display electrodes has been considered. The approach has a problem of raising the discharge firing voltage.

Figure 2:
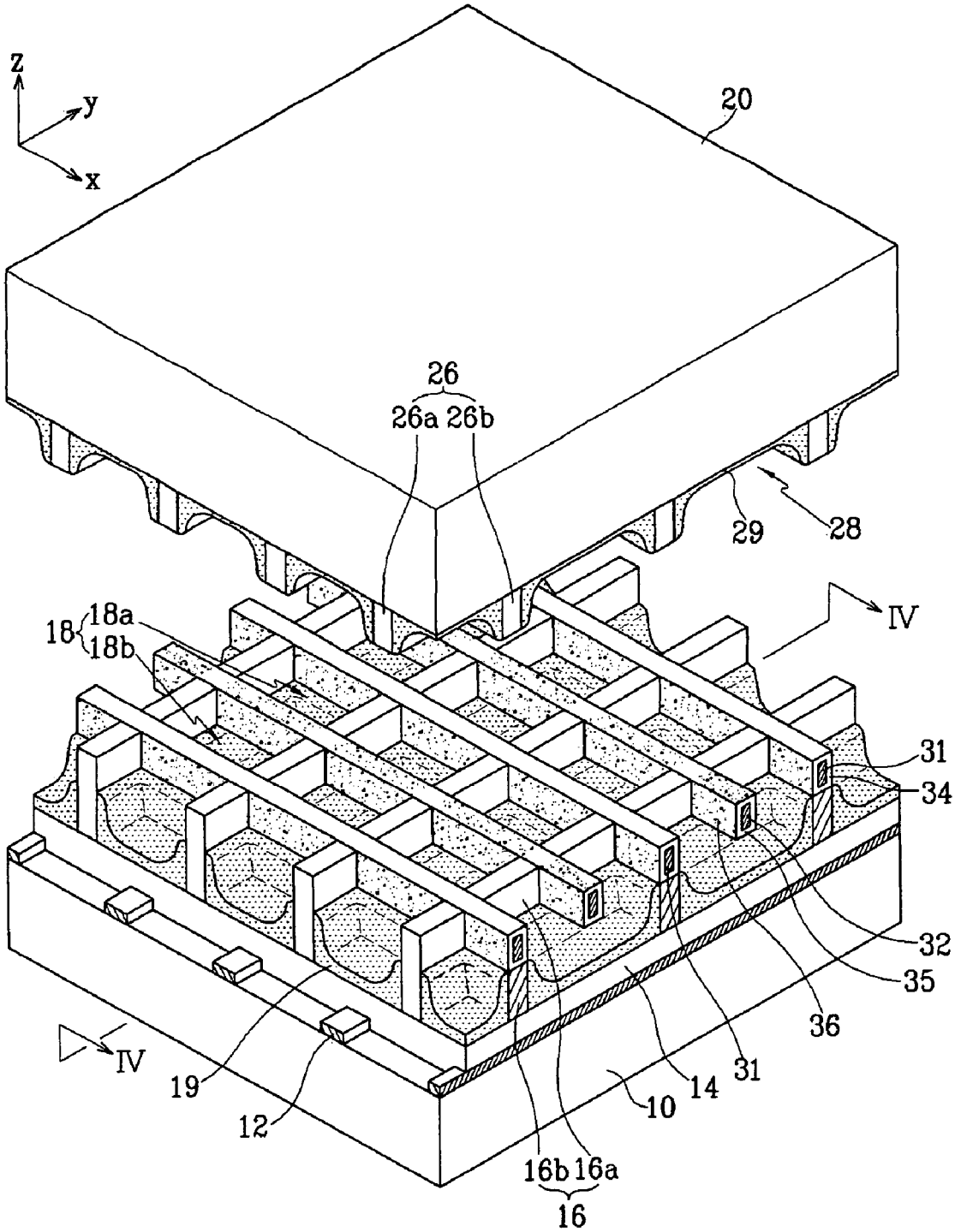
FIG. 2 is a partially exploded perspective view of a plasma display panel (PDP) according to a first embodiment of the present invention.
Figure 3:
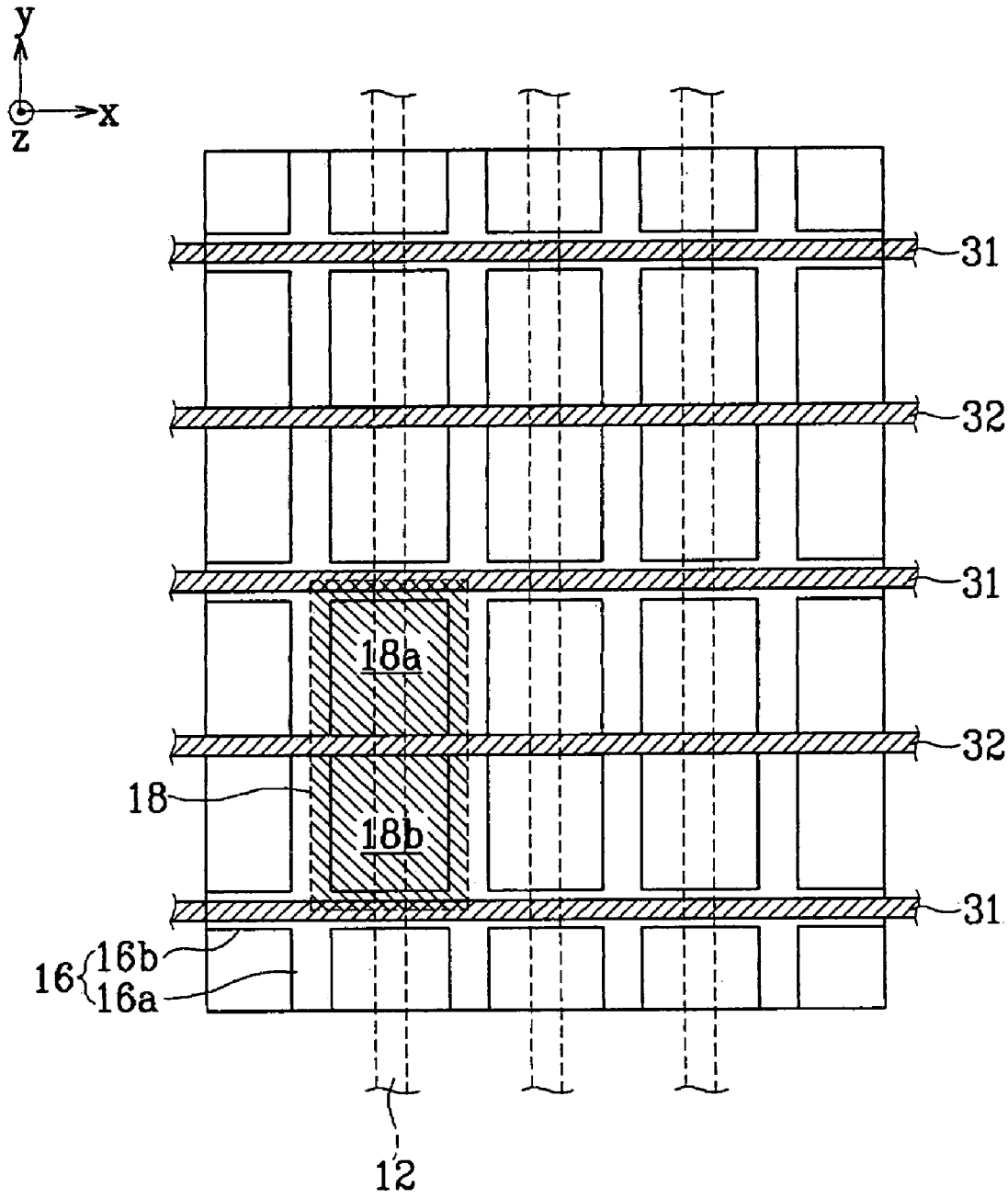
FIG. 3 is a schematic plan view of an electrode and discharge cell structure of the PDP according to the first embodiment of the present invention.
Figure 4:
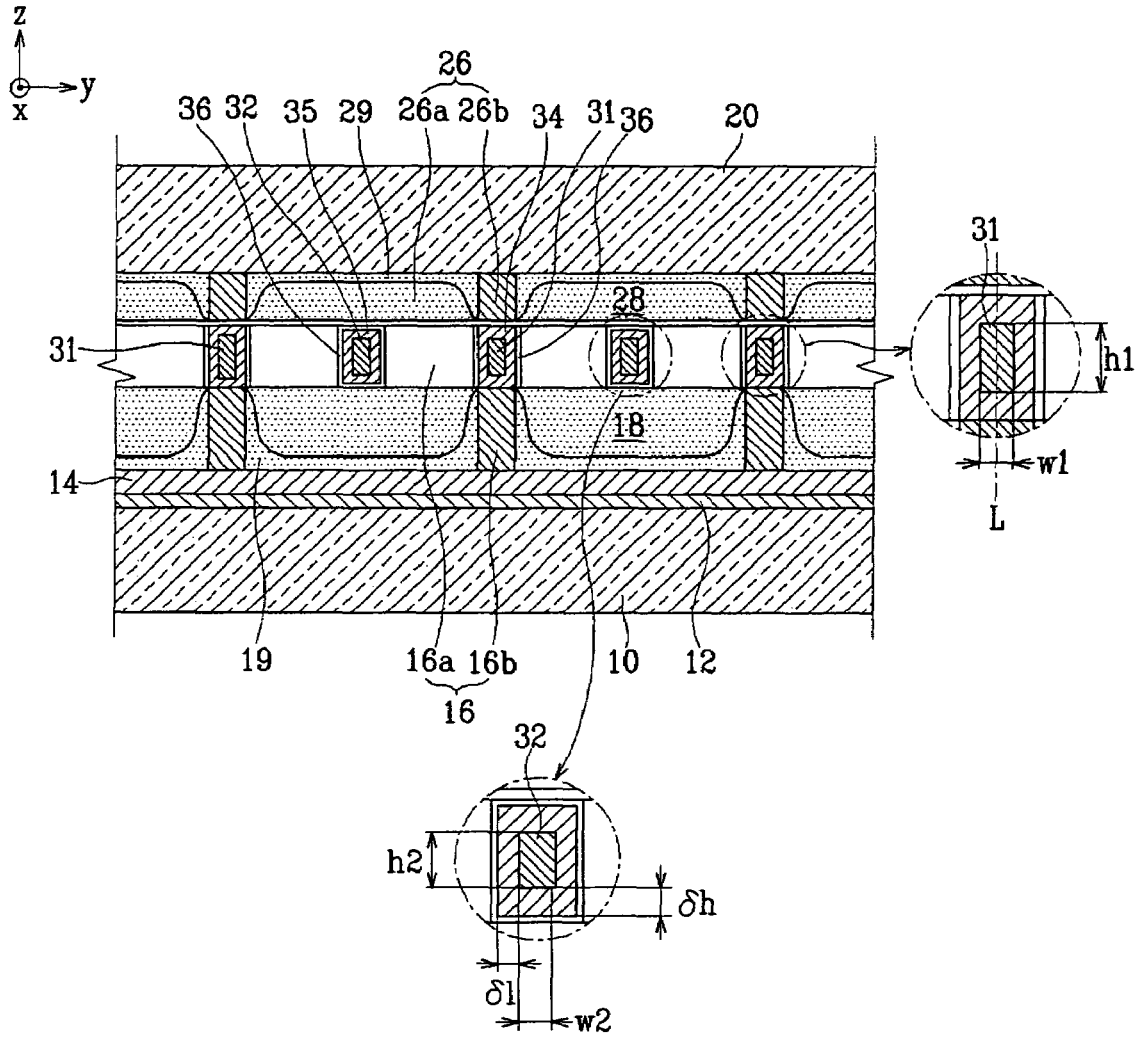
FIG. 4 is a partially cross-sectional view taken along line IV-IV of FIG. 2 of the assembled PDP.

Turning now to FIGS. 2 through 4, FIG. 2 is a partial exploded perspective view of a PDP according to a first embodiment of the present invention, FIG. 3 is a schematic plan view of an electrode and discharge cell structure of the PDP according to the first embodiment of the present invention and FIG. 4 is a partially cross-sectional view taken along line IV-IV of FIG. 2 of the assembled PDP.

The PDP according to the first embodiment includes a first substrate 10 (hereinafter, referred to as a rear substrate) and a second substrate 20 (hereinafter, referred to as a front substrate). The rear and front substrates 10 and 20 face each other with a predetermined interval in between to provide for the discharge space. The discharge space is partitioned by barrier ribs 16 and 26 to define a plurality of discharge cells 18.

Phosphor layers 19 and 29 are located to coat sidewalls of the barrier ribs 16 and 26 and bottom surfaces of the discharge cells 18. The phosphor layers 19 and 29 absorb vacuum ultraviolet (VUV) light and emit visible light. The discharge cells 18 of the discharge space are filled with discharge gas, such as a mixture of Xe and Ne.

Address electrodes 12 are located parallel to each other on an inner surface of the rear substrate 10 and extend in a first direction (y-direction in the figure). A dielectric layer 14 is located on the inner surface of the rear substrate 10 to cover the address electrodes 12. The adjacent address electrodes 12 are separated from each other by a predetermined distance, that is, an x-directional distance between the adjacent discharge cells 18.

The barrier ribs 16 and 26 includes rear-substrate barrier ribs 16 protruding from the rear substrate 10 towards the front substrate 20 and front-substrate barrier ribs 26 protruding from the front substrate 20 towards the rear substrate 10.

The rear-substrate barrier ribs 16 are located on the dielectric layer 14 that is located on the rear substrate 10. The rear-substrate barrier ribs 16 are made up of first barrier rib elements 16*a* extending in the first direction and parallel to the address electrodes 12 and second barrier rib elements 16*b* extending in a second direction and intersecting the first barrier rib elements 16*a* to define the discharge cells 18 as individual discharge spaces. The front-substrate barrier ribs 26 are made up of third barrier rib elements 26*a* corresponding to the first barrier rib elements 16*a* and fourth barrier rib elements 26*b* corresponding to the second barrier rib elements 16*b*. The third and fourth barrier rib elements 26*a* and 26*b* intersect each other to define regions 28 corresponding to the discharge cells 18.

First electrodes 31 are located corresponding to the second barrier rib elements 16*b* between the rear and front substrate 10 and 20 and extend in the second direction (x direction in the figure) parallel to the second barrier rib elements 16*b*. More specifically, the first electrodes 31 are located above top surfaces of the second barrier rib elements 16*b* to partition the discharge cells 18 in the longitudinal first direction (y direction in the figure) parallel to the address electrodes 12.

The second electrodes 32 are located between the adjacent first electrodes 31. Therefore, the second electrodes 32 are located to pass through internal spaces of the discharge cells 18 in the direction intersecting the first barrier rib elements 16*a*. The second electrodes 32 together with the address electrodes 12 take part to form discharges during an address period to select to-be-displayed discharge cells 18. The pairs of first electrodes 31 together with the second electrodes 32 take part to form discharges during sustain periods to display an image on a screen. These electrodes can have different functions according to applied signal voltages and thus the present invention is not limited thereto.

Referring to FIG. 3, each of the discharge cells 18 is divided into two regions 18*a* and 18*b* by the second electrode 32. In a sustain period, in each of the regions 18*a* and 18*b*, sustain discharges are generated between the first and second electrodes 31 and 32. Since the sustain discharges are generated between the second electrode 32 and the first electrodes 31 located at the left and right sides of the second electrode 32 across the discharge cell 18, a discharge gap of the PDP according to the present invention can be reduced by about half by using the arrangement of FIGS. 2 through 4. Therefore, it is possible to drive the PDP with a relatively low discharge firing voltage.

Referring to FIG. 4, in this first embodiment, transverse cross sections of the first electrodes 31 and the corresponding second barrier ribs 16*b* have substantially the same central lines L. Therefore, each of the first electrodes 31 can be used to form discharges in both regions 18*a* and 18*b* of the discharge cell 18, which are adjacent to each other in the longitudinal first direction (y direction in the figure) along the address electrodes 12.

In this first embodiment, heights h1 of the transverse cross sections of the first electrodes 31 in a direction perpendicular to the substrates 10 and 20 (z direction) are larger than widths w1 thereof in a direction parallel to the substrates 10 and 20 (y direction). In addition, heights h2 of the transverse cross sections of the second electrodes 32 are larger than widths w2 thereof. Therefore, facing discharge can be more easily generated between the first and second electrodes 31 and 32. As a result, it is possible to obtain a high luminance efficiency.

The first and second electrodes 31 and 32 are surrounded by dielectric layers 34 and 35, respectively. The first and second electrodes 31 and 32 can be made by using a thick film ceramic sheet (TFCS) method. More specifically, electrode portions including the first and second electrodes 31 and 32 can be individually formed, and then, assembled into the rear substrate 10 where the barrier ribs are formed. Here, the electrodes are coated with a ceramic material.

An MgO protective layer 36 can be formed on the dielectric layers 34 and 35 covering the first and second electrodes 31 and 32 respectively. In particular, the MgO protective layer 36 can be formed on portions of the discharge cell 18 exposed to the plasma discharge therein. In this first embodiment, since the first and second electrode 31 and 32 are not located on the front substrate 20, the protective layer 36 coated on the dielectric layers 34 and 35 covering the first and second electrodes 31 and 32 can be made of MgO that is not transparent to visible light. MgO that is not transparent to visible light has a higher secondary electron emission coefficient than a MgO that is transparent to visible light. Therefore, it is possible to further reduce the discharge firing voltage.

In the embodiment, a thickness δh of a dielectric layer 35 coated on a bottom surface of the second electrode 32 facing the rear substrate 10 is larger than a thickness δ1 of the dielectric layer 35 coated on a side surface of the second electrode 32 facing the first electrode 31. With such an arrangement, it is possible to prevent an address discharge from occurring between the address electrodes 12 and the bottom surfaces of the second electrodes 32. As a result, the address discharge can be generated between the side surface of the second electrode 32 and the address electrode 12.

The first electrodes 31 are provided with the dielectric layer 34. An MgO protective layer 36 is also provided between the second and fourth barrier rib elements 16*b* and 26*b* which are parallel to each other. On the other hand, the second electrodes 32 are provided with the dielectric layer 35. An MgO protective layer 36 is located between the first and third barrier rib elements 16*a* and 26*a*. Second electrodes 32 run in a direction that intersects the first and the third barrier rib elements 16*b* and 26*b*.

In order to form the second electrodes 32, grooves can be formed on some portions of the first barrier rib elements 16*a*, and the second electrodes 32 coated with the dielectric layer 35 and the MgO protective layer 36 can be inserted into the grooves. Here, the distance between the second electrode 32 and the rear substrate 10 can be equal to the distance between the first electrode 31 and the rear substrate 10. A top surface of the dielectric layer 35 surrounding the second electrode 32 can be flush with a top surface of the first barrier rib element 16*a*. The second electrodes 32 can pass through the first barrier rib elements 16*a*. The first and second electrodes 31 and 32 are preferably made of a highly conductive metallic material.

Phosphor layers 29 are formed in regions 28 on the front substrate 20 partitioned by the third and fourth barrier rib elements 26*a* and 26*b*. After a dielectric layer is coated on the front substrate 20 and the front-substrate barrier ribs 26 are formed on the dielectric layer, the phosphor layers 29 are coated on the remaining dielectric layer. Alternatively, if a dielectric layer is not formed on the front substrate 20, the front-substrate barrier ribs 26 are formed directly on the front substrate 20 and the phosphor layers 29 can be coated directly on the front substrate 20. In addition, after the front substrate 20 is etched according to shapes of the discharge cells 18, the phosphor layers 29 can be coated thereon. In this case, the front-substrate barrier ribs 26 are made of the same material as the front substrate 20.

The phosphor layers 29 formed on the front substrate 20 serve to absorb VUV rays emitted from the plasma discharge that propagate from the discharge cells 18 toward the front substrate 20. The phosphor layers 29 must allow the visible light to pass therethrough. Therefore, a thickness of the phosphor layers 29 located on the front substrate 20 is preferably smaller than a thickness of the phosphor layers 19 located on the rear substrate 10. With such a design, it is possible to minimize loss of VUV light while improving the luminous efficiency.

Figure 5:
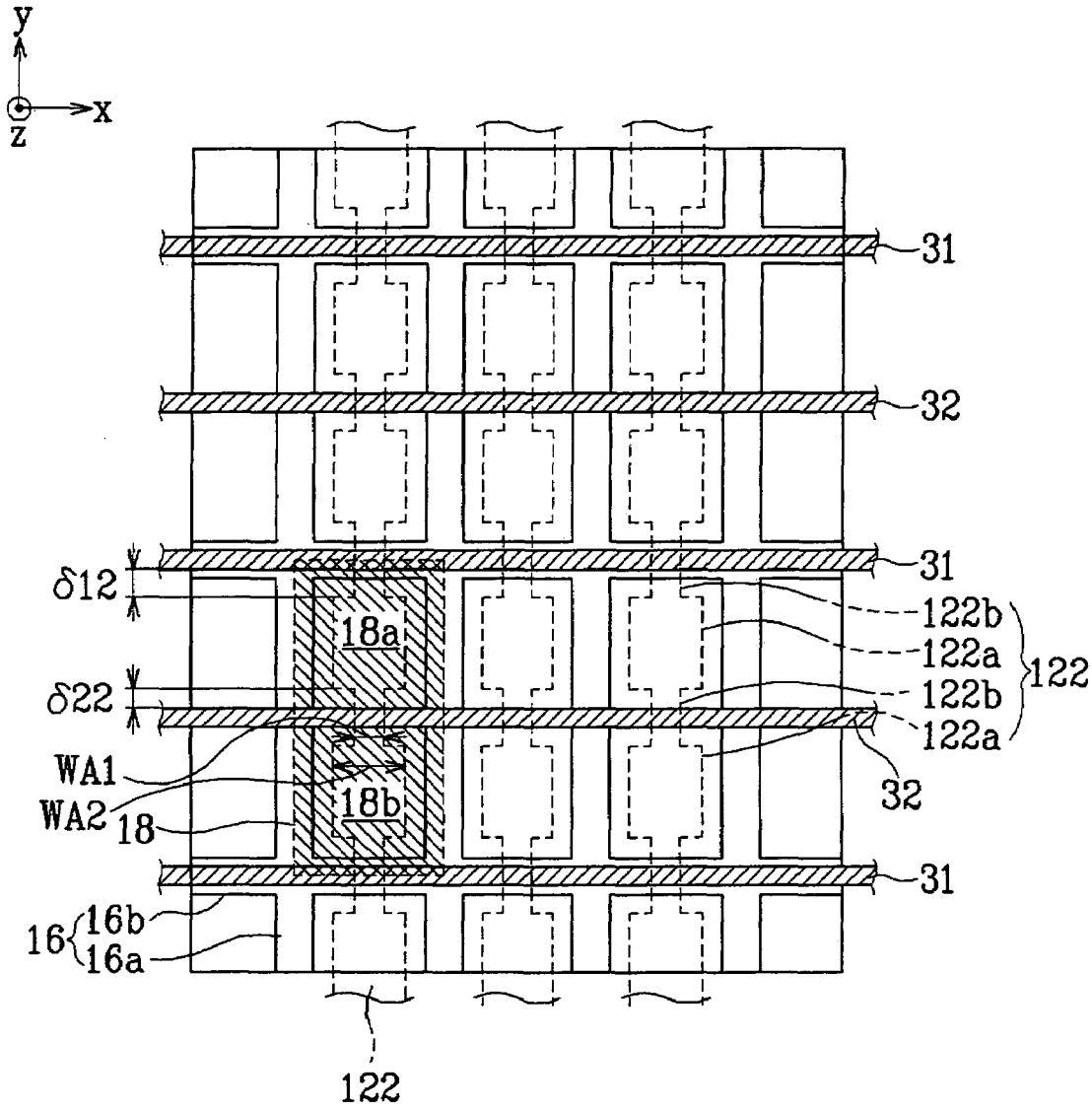
FIG. 5 is a schematic plan view of an electrode and discharge cell structure of a PDP according to a second embodiment of the present invention.

Turning now to FIG. 5, FIG. 5 is a schematic plan view of an electrode and discharge cell structure of a PDP according to a second embodiment of the present invention. The basic features of the second embodiment of the present invention are similar to those of the first embodiment, and thus the detailed description of similar items will be omitted. Constructions of the address electrodes are different between the embodiments and thus the following description will focus primarily on the construction of the address electrodes.

Referring to FIG. 5, each of the address electrodes 122 are made up of two address discharge generation portions 122*a* corresponding to the two regions 18*a* and 18*b* of the discharge cell 18, and connection portions 122*b* connecting together the two address discharge generation portions 122*a*. The address electrodes 122 are located to extend in the first direction (y direction in FIG. 5).

The two address discharge generation portions 122*a* are located on the two corresponding regions 18*a* and 18*b* between the first and second electrodes 31 and 32. The connection portions 122*b* are located to intersect the second electrode 32 and the second barrier rib element 16*b*. Therefore, as described above, it is possible to prevent the address discharge from occurring between the bottom surfaces of the second electrodes 32 and the address electrodes 12. In addition, the address discharge can be generated in the two regions 18*a* and 18*b* of the discharge cell 18 between the first and second electrodes 31 and 32. As a result, a large number of wall charges can be formed on the side surfaces of the dielectric layers 34, 35 on the first electrodes 31 and the second electrode 32, so that the sustain discharge can be generated.

The address discharge generation portion 122*a* has a larger width WA2 and the connection portion 122*b* has a smaller width WA1. A width WA1 of the connection portion 122*b* taken in a direction (x direction in the figure) intersecting the address electrode 122 is smaller than a width WA2 of the address discharge generation portion 122*a* in the direction intersecting the address electrode 122. Since the two address discharge generation portions 122*a* having a large width WA2 are provided at the two corresponding regions 18*a* and 18*b* of the respective discharge cell 18, it is possible to easily generate the address discharge in comparison to at the connection portions 122*b*.

The address discharge generation portions 122*a* can be made to have a variety of different shapes. In the embodiment of FIG. 5, the address discharge generation portions 122*a* are illustrated to have a rectangular shape between the first and second electrodes 31 and 32. Therefore, the address discharge generation portions 122*a* can have a large area that corresponds to the rectangular regions 18*a* and 18*b* of the discharge cell 18 between the first and second electrodes 31 and 32. The address discharge generation portions 122*a* preferably have a shape that corresponds to the shapes of the regions of the discharge cells 18.

Each of the address discharge generation portions 122*a* forms first gap δ12 between the address discharge generation portion 122*a* and the first electrode 31 and second gap δ22 between the address discharge generation portion 122*a* and the second electrode 32. The first gap δ12 prevents misaddressing between the adjacent discharge cells 18. The second gap δ22 prevents the address discharge from occurring just under the second electrode 32. The first gap δ12 is preferably larger than the second gap δ22.

Figure 6:
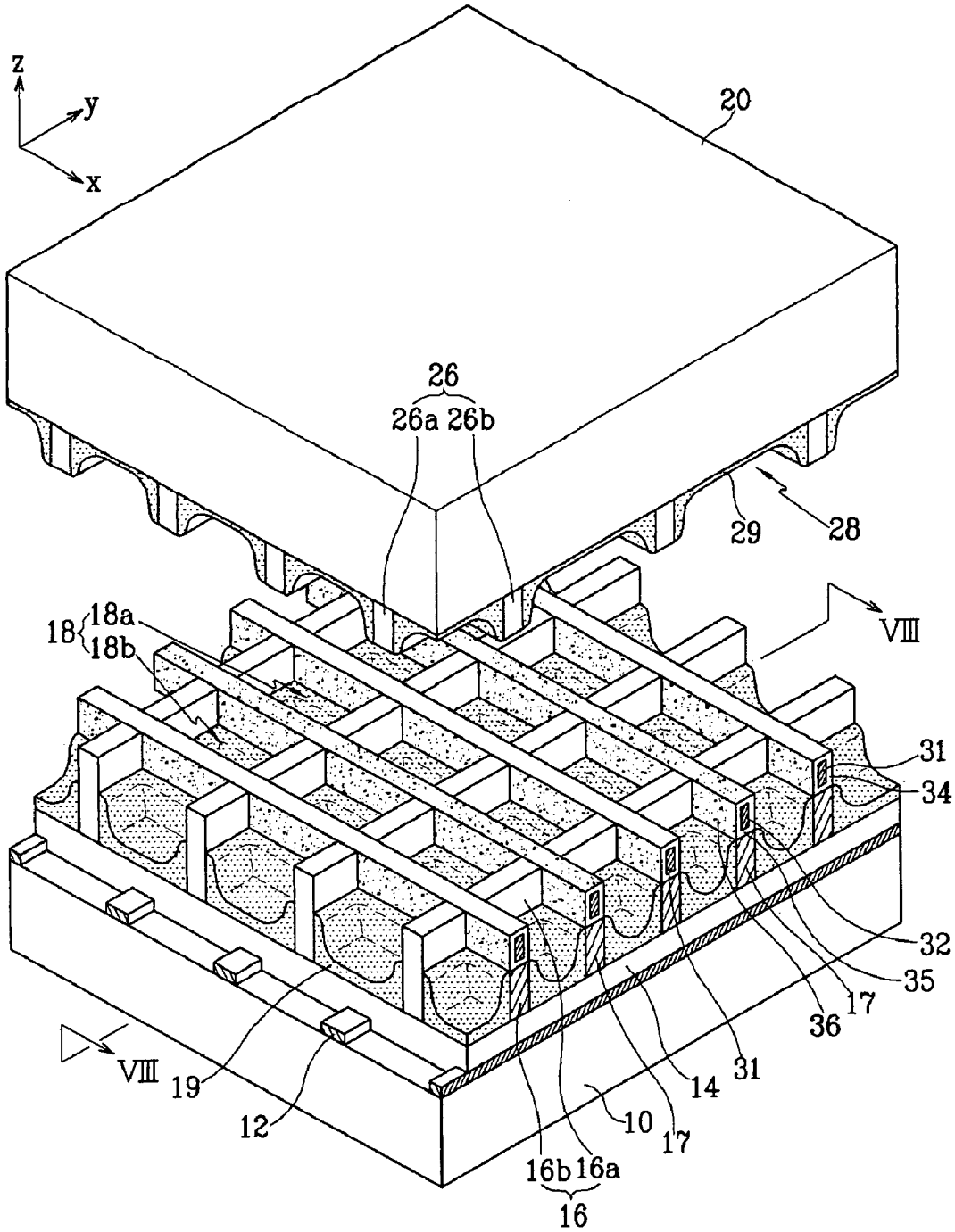
FIG. 6 is a partially exploded perspective view of a PDP according to a third embodiment of the present invention.
Figure 7:
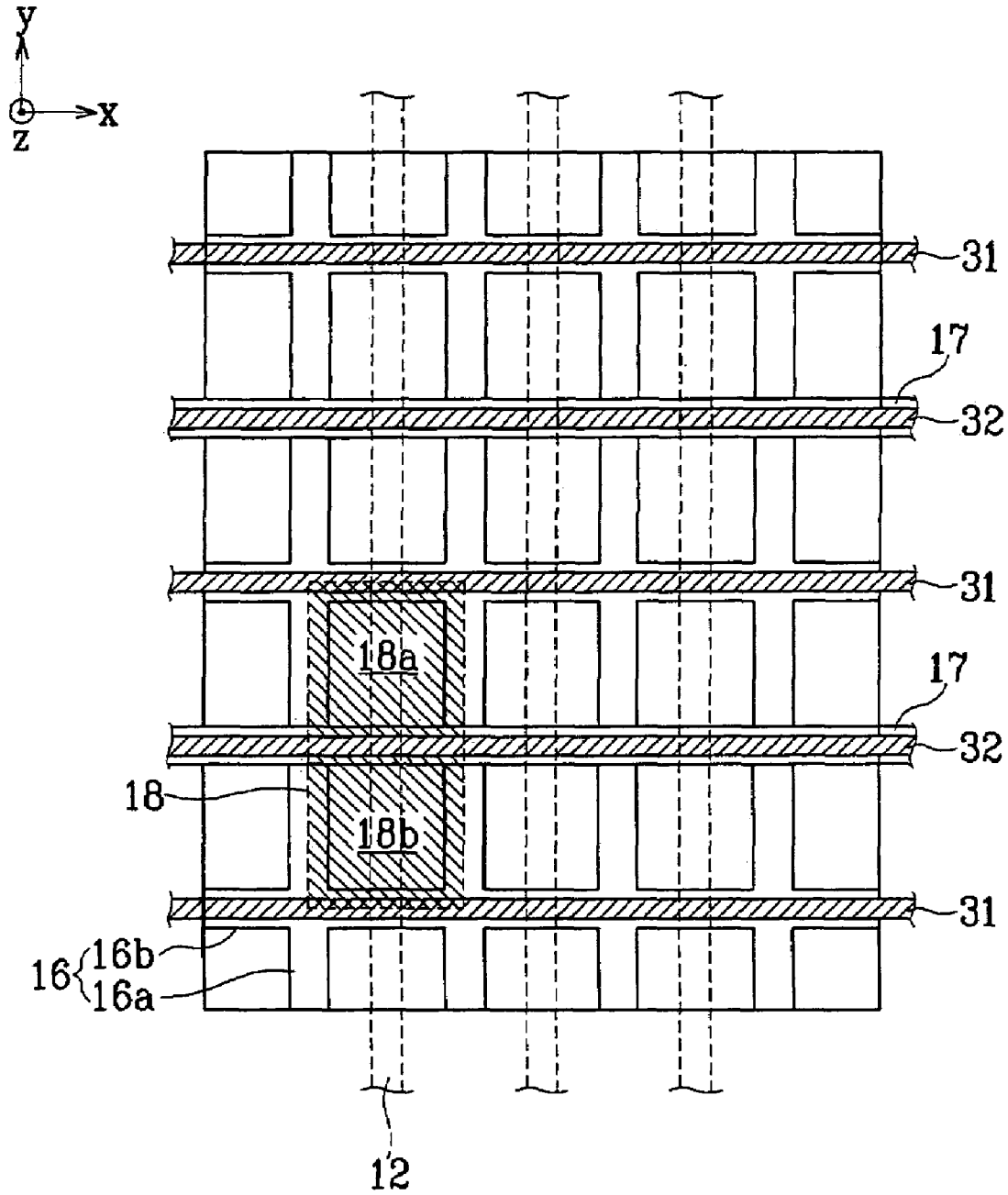
FIG. 7 is a schematic plan view of an electrode and discharge cell structure of the PDP according to the third embodiment of the present invention.
Figure 8:
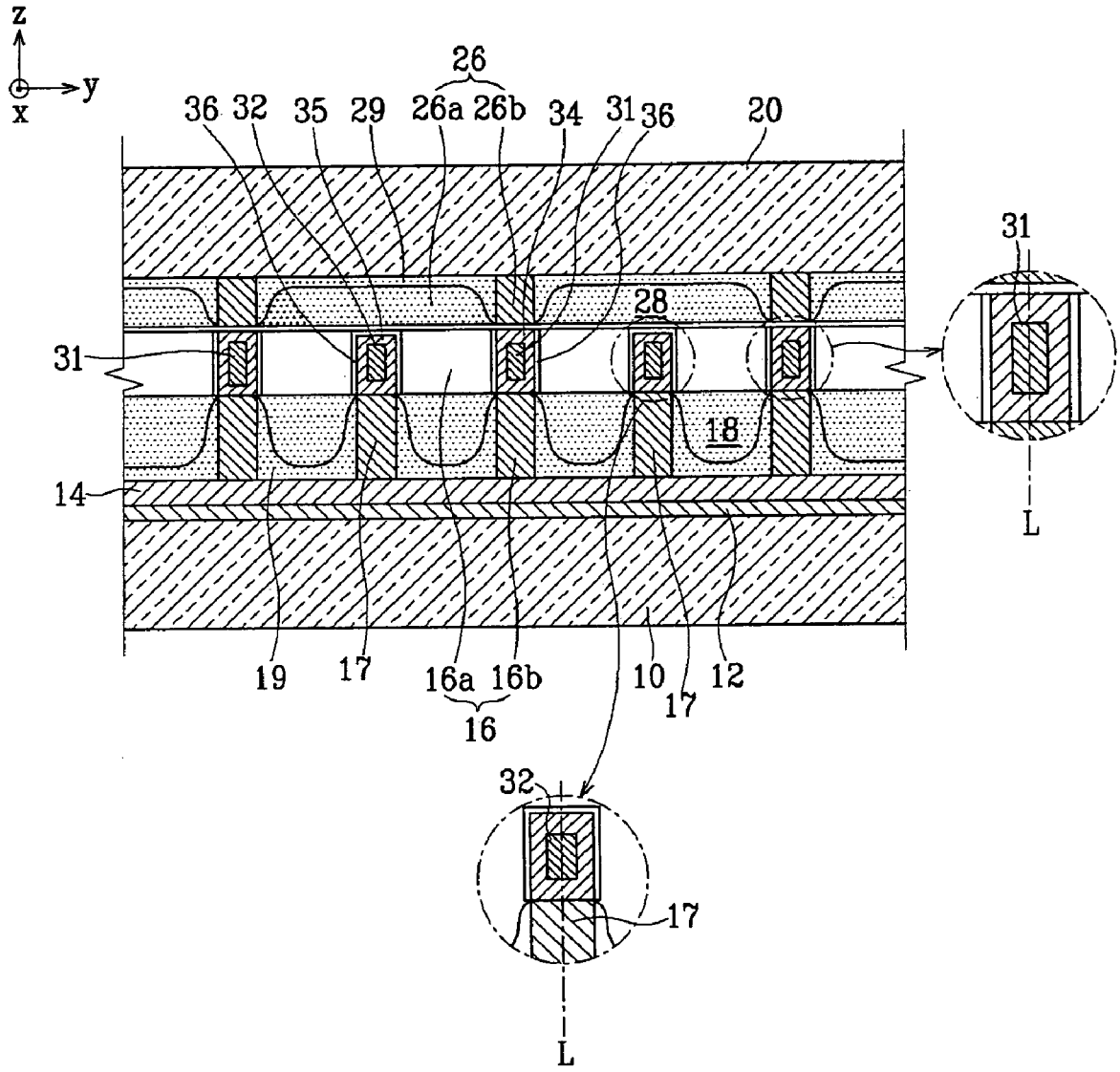
FIG. 8 is a partially cross-sectional view taken along line VIII-VIII of FIG. 6 of the assembled PDP.

Turning now to FIGS. 6, 7 and 8, FIG. 6 is a partially exploded perspective view of a PDP according to a third embodiment of the present invention, FIG. 7 is a schematic plan view of an electrode and discharge cell structure of the PDP according to the third embodiment of the present invention and FIG. 8 is a partially cross-sectional view taken along line VIII-VIII of FIG. 6 of the assembled PDP.

Referring to FIGS. 6 and 7, the structure of the PDP according to the third embodiment is similar to that of the PDP according to the first embodiment. The difference is that auxiliary barrier rib elements 17 are further located between adjacent second barrier rib elements 16*b*. Namely, the auxiliary barrier rib elements 17 and the second barrier rib elements 16*b* are alternately located along the longitudinal direction (y direction in the figure) of the address electrodes 12. Therefore, the auxiliary barrier rib elements 17 are located on the rear substrate 10 to partition discharge cells 18 into the two regions 18*a* and 18*b*. In addition, the second electrodes 32 are located corresponding to the auxiliary barrier rib elements 17 (located between second barrier rib elements 16*b*) and extend in the second direction (x direction in the figures).

Referring to FIG. 8, in the third embodiment, transverse cross sections of the second electrodes 32 and the corresponding auxiliary barrier rib elements 17 have substantially the same central lines L. Therefore, each of the second electrodes 32 can be used to produce discharges in both regions 18*a* and 18*b* of the discharge cells 18.

The first electrodes 31, provided with the dielectric layer 34 and the MgO protective layer 36, are located between the second and fourth barrier rib elements 16*b* and 26*b* and extend parallel the second and the fourth barrier rib elements 16*b* and 26*b*. Similarly, the second electrodes 32, provided with the dielectric layer 35 and the MgO protective layer 36, are located between the auxiliary barrier rib elements 17 and the third barrier rib elements 26*a* and run in a direction parallel to the auxiliary barrier rib elements 17 and intersecting the third barrier rib elements 26*a*.

In order to make the second electrodes 32 and the auxiliary barrier rib elements 17, grooves can be formed on some portions of the first barrier rib elements 16*a*, and the second electrodes 32 coated with the dielectric layer 35 and the MgO protective layer 36 can be inserted into the grooves.

In the third embodiment, since the second electrodes 32 are located to correspond to the auxiliary barrier rib elements 17, it is possible to support the second electrodes 32 in the discharge cells 18 thus resulting in a more stable structure. It is also possible to prevent an address discharge from occurring underneath the second electrodes 32 by having the auxiliary barrier rib elements 17 present so that the address discharge can be generated between the side surfaces of the second electrodes 32 and the address electrodes 12. In the third embodiment, since the phosphor layers 19 are further located on the side surfaces of the auxiliary barrier rib elements 17, it is possible to increase the total area that the phosphor layers 19 are present, resulting in a greater ability to absorb and convert VUV rays. This results in an increase of visible light emitted from the PDP.

Figure 9:
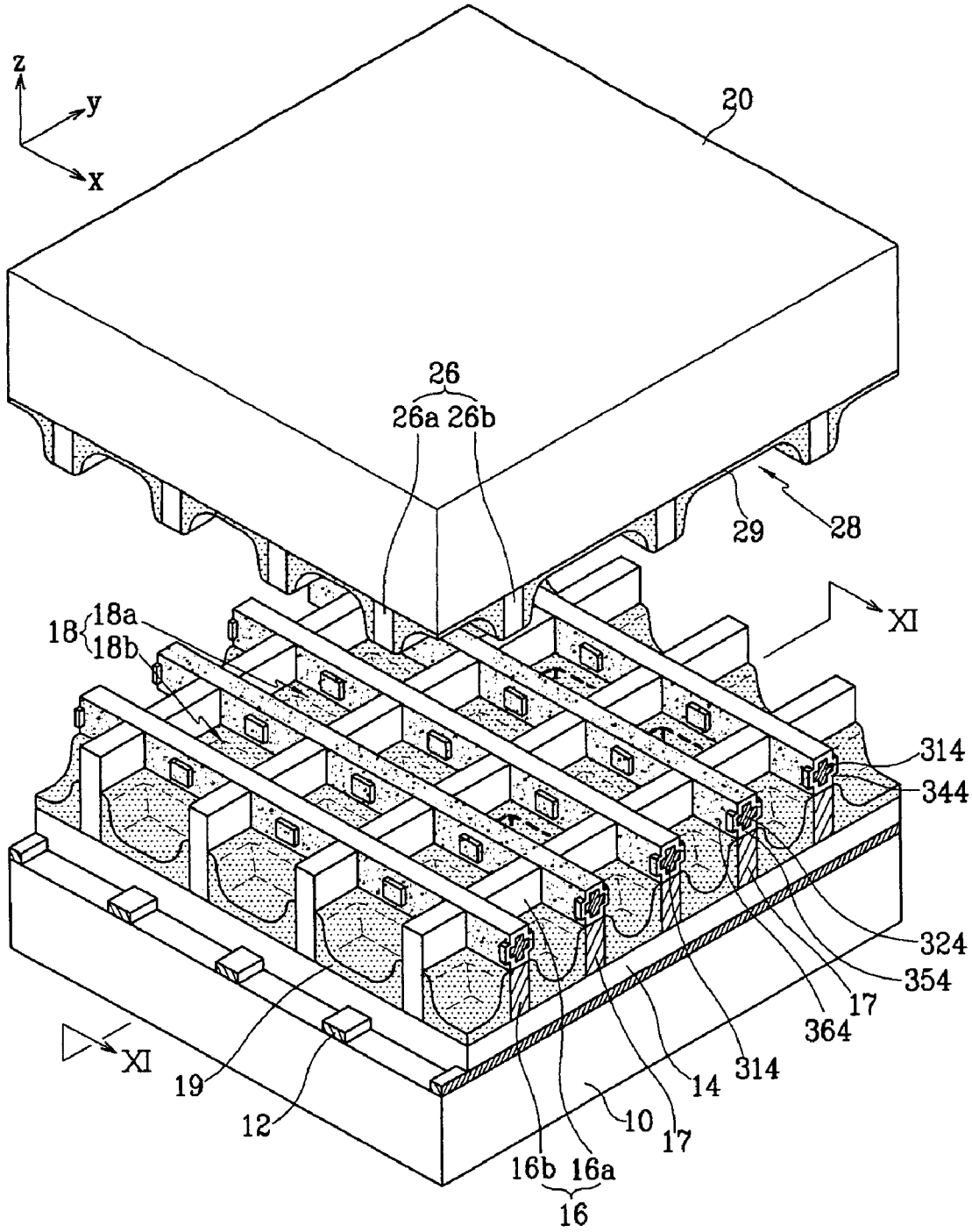
FIG. 9 is a partially exploded perspective view of a PDP according to a fourth embodiment of the present invention.
Figure 10:
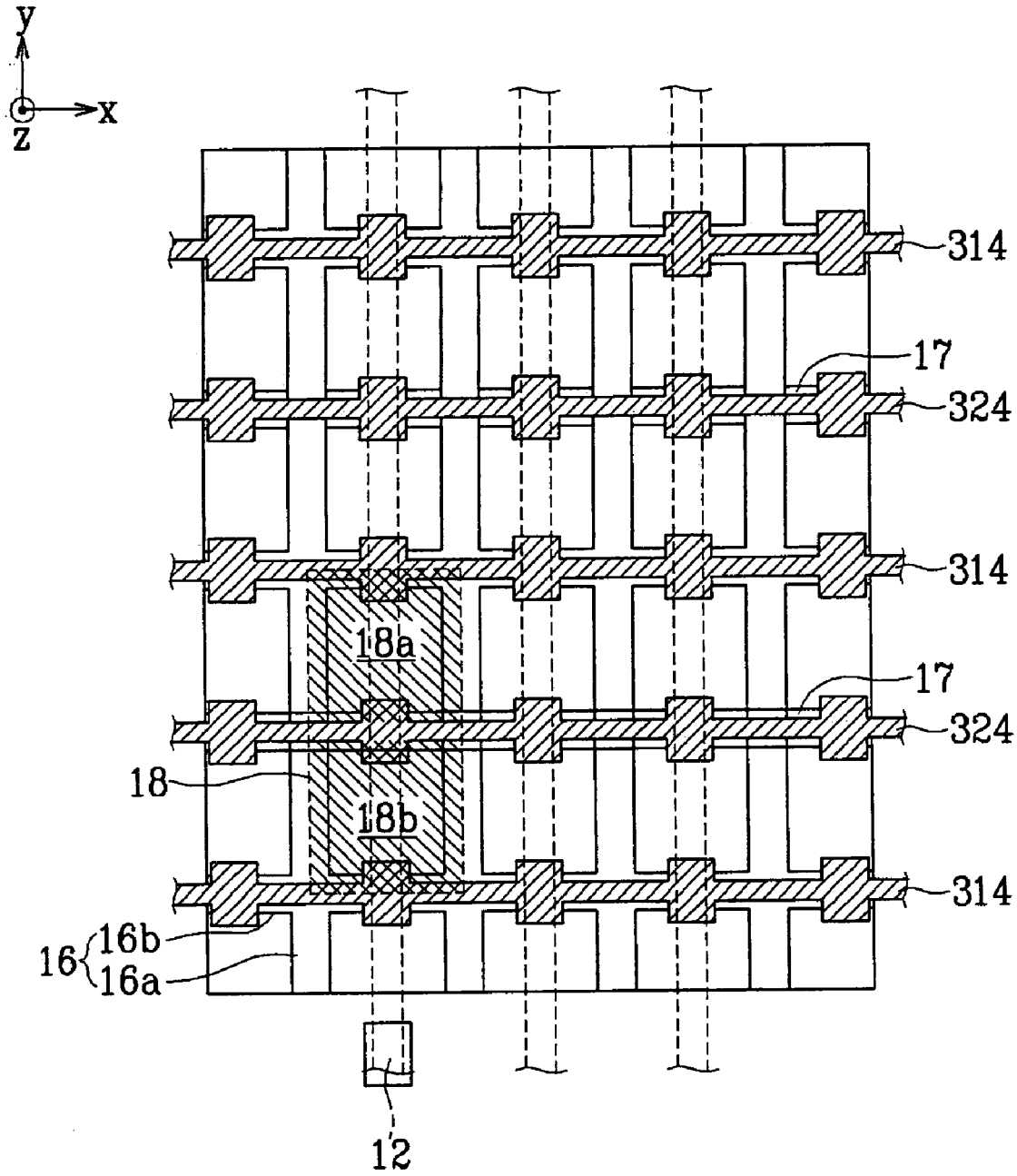
FIG. 10 is a schematic plan view of an electrode and discharge cell structure of the PDP according to the fourth embodiment of the present invention.
Figure 11:
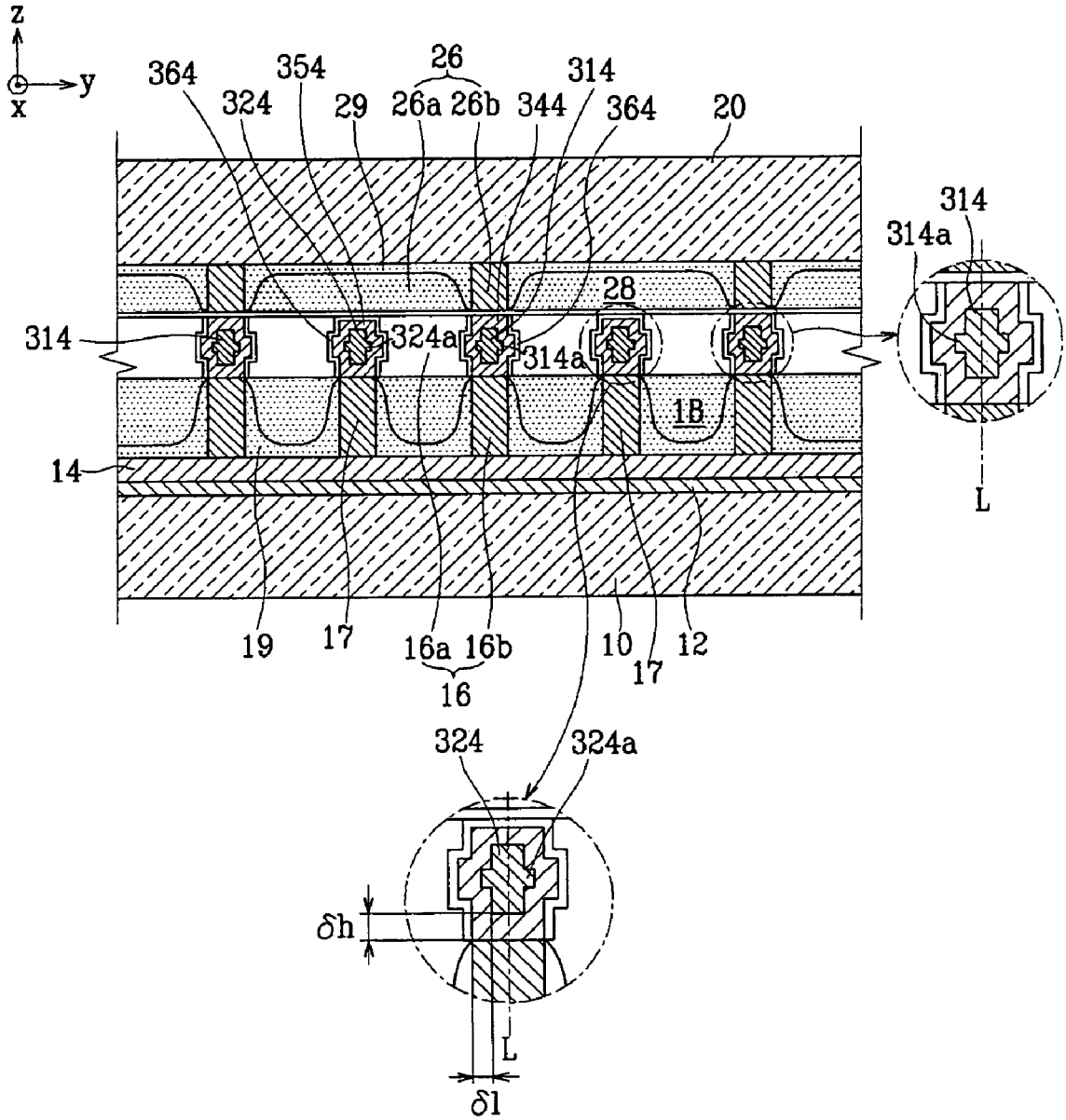
FIG. 11 is a partially cross-sectional view taken along line XI-XI of FIG. 9 of the assembled PDP.

Turning now to FIGS. 9, 10 and 11, FIG. 9 is a partial exploded perspective view of a PDP according to a fourth embodiment of the present invention, FIG. 10 is a schematic plan view of an electrode and discharge cell structure of the PDP of FIG. 9 and FIG. 11 is a partially cross-sectional view taken along line XI-XI of FIG. 9 of the assembled PDP.

Referring to FIGS. 9, 10 and 11, the structure of the PDP according to the fourth embodiment is similar to that of the PDP according to the third embodiment. The difference is that the first and second electrodes 314 and 324 have the protrusions 314*a* and 324*a* protruding toward the second and first electrodes 324 and 314 in the discharge cells 18, respectively. The protrusions can be formed on both the first and the second electrodes 314 and 324 or only on one of the first electrodes 314 and the second electrodes 324.

The protrusions 314*a* and 324*a* can be located at various locations along the direction perpendicular to the longitudinal direction of the first electrode 314 between the rear and front substrates 10 and 20. In the fourth embodiment, the protrusions 314*a* and 324*a* are located at the central positions between the rear and front substrates 10 and 20. Alternatively, the protrusions 314*a* and 324*a* can be located closer to the rear substrate 10 or the front substrate 20 than the central positions.

In addition, although the auxiliary barrier rib elements 17 are illustrated as being present in the fourth embodiment of FIGS. 9 and 11, the auxiliary barrier rib elements 17 need not be present. When auxiliary barrier rib elements 17 are not present, thickness δh of a dielectric layer 354 coated on the bottom surface of the second electrode 324 facing the rear substrate 10 needs to be larger than a thickness δ1 of the dielectric layer 354 coated on a side surface of the second electrode 324 facing the first electrode 314. By designing the dielectric layer 354 as such, it is possible to prevent an address discharge from occurring between the address electrodes 12 and the bottom surfaces of the second electrodes 324.

In addition, the discharge gap between the first and second electrodes 314 and 324 can be further reduced when the protrusions 314*a* and 324*a* are present, resulting in a further reduction of the discharge firing voltage. In addition, the protrusions 314*a* and 324*a* lengthen the discharge path after the discharge is fired, so that it is possible to further increase the luminous efficiency.

Turning now to FIGS. 12 through 16, FIGS. 12 through 16 illustrate PDPs according to the fifth through ninth embodiments respectively. As illustrated in FIGS. 12 to 16, the PDPs according to the fifth through ninth embodiments are unique due to their different cross sectional shapes of the first and second electrodes. Hereinafter, since the functions and effects of the PDPs of the fifth through ninth embodiments are similar to those of the PDP of the fourth embodiment, the detail description of like features will be omitted. The following description will be mainly focus on how the fifth through ninth embodiments differ from the fourth embodiment.

As described above in the fourth embodiment, the first electrodes 314 have protrusions 314*a* protruding toward the second electrodes 324, and second electrodes 324 have protrusions 324*a* protruding toward the first electrodes 314. Namely, the first and second electrodes 314 and 324 have the protrusions 314*a* and 324*a*, respectively.

Figure 12:
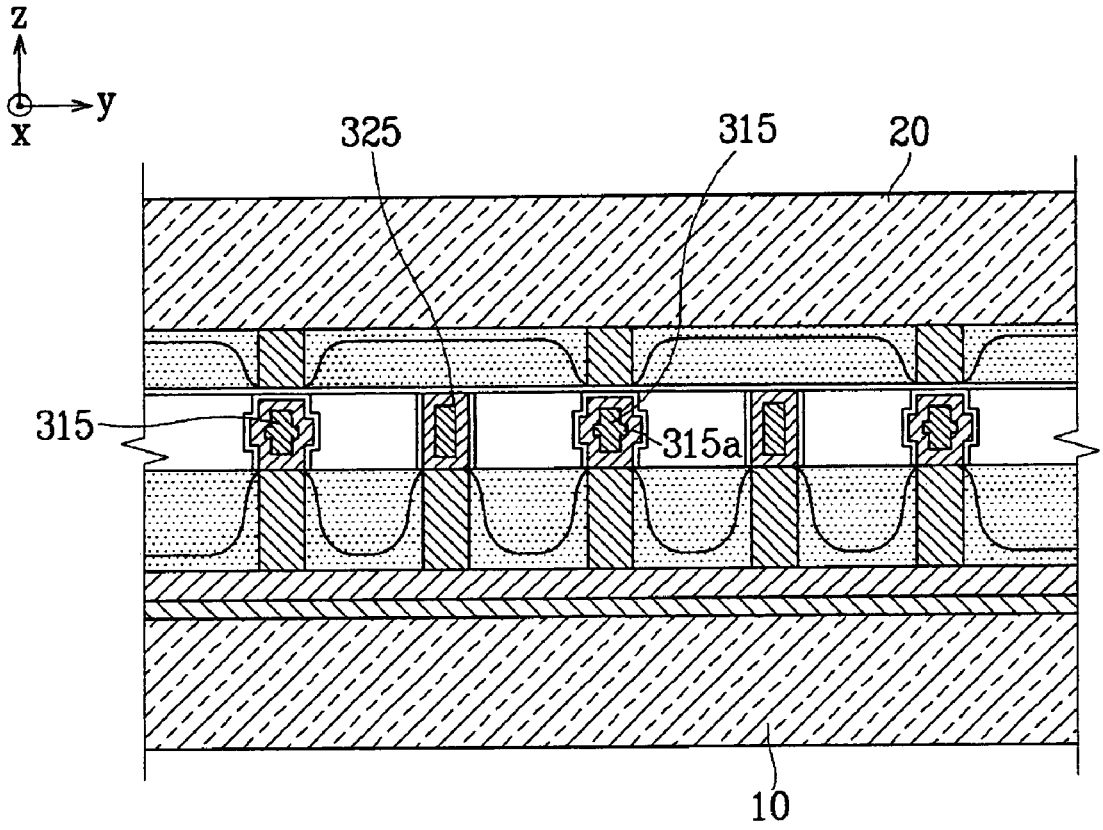
FIG. 12 is a partial plan view of a PDP according to a fifth embodiment of the present invention.

Turning now to FIG. 12, FIG. 12 is a partial plan view of a PDP according to the fifth embodiment of the present invention. In the fifth embodiment, first electrodes 315 have protrusions 315*a* facing the second electrodes 325, but the second electrodes 325 have no protrusions. Therefore, transverse cross sections of the second electrodes 325 have a rectangular shape. The height of the transverse cross section of the second electrode 325 in the direction perpendicular to the rear and front substrates 10 and 20 is larger than the width thereof in the direction parallel to the rear and front substrates 10 and 20.

Figure 13:
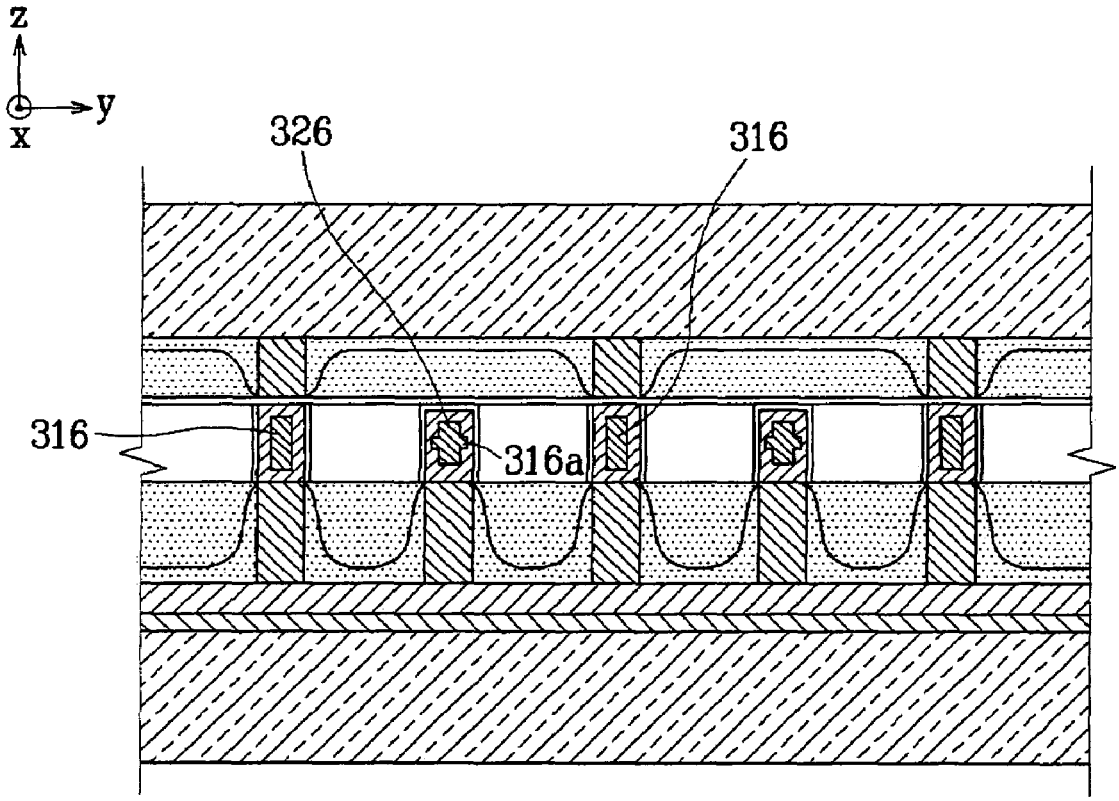
FIG. 13 is a partial plan view of a PDP according to a sixth embodiment of the present invention.

Turning now to FIG. 13, FIG. 13 is a partial plan view of a PDP according to the sixth embodiment of the present invention. In the sixth embodiment, first electrodes 316 have no protrusions, but second electrodes 326 have protrusions 326*a* facing the first electrodes 316. Therefore, transverse cross sections of the first electrodes 316 have a rectangular shape.

Figure 14:
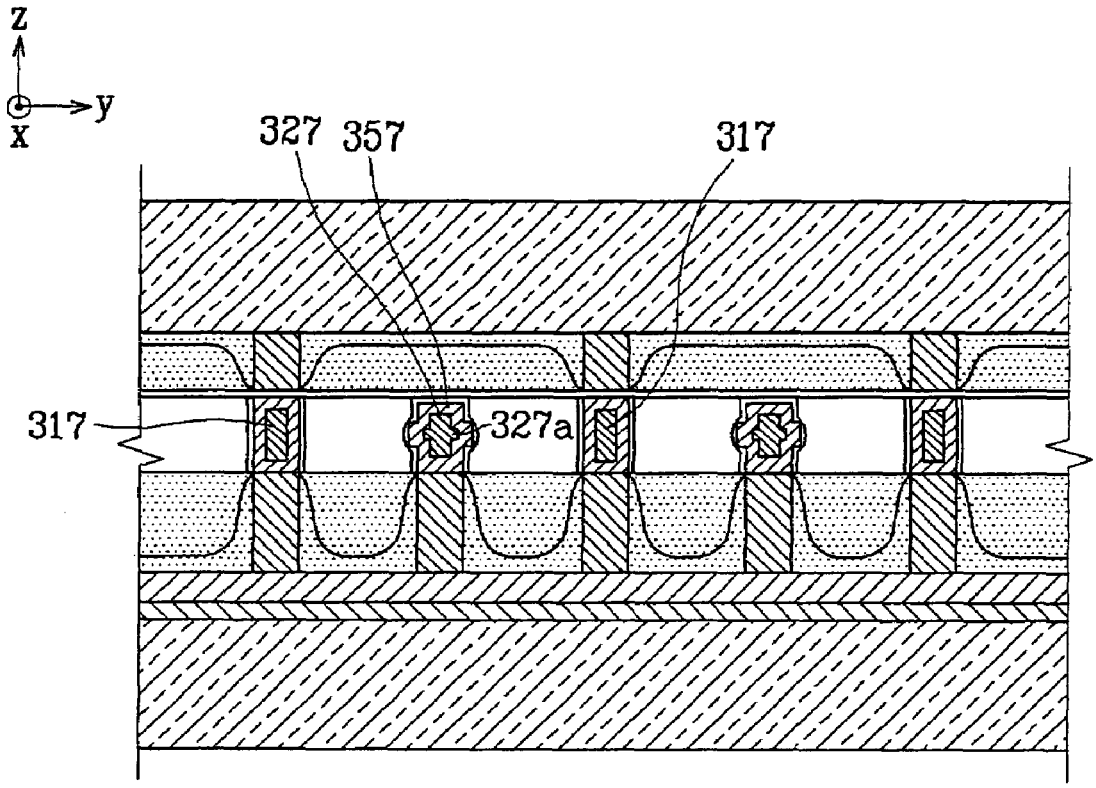
FIG. 14 is a partial plan view of a PDP according to a seventh embodiment of the present invention.

Turning now to FIG. 14, FIG. 14 is a partial plan view of a PDP according to the seventh embodiment of the present invention. In the seventh embodiment, first electrodes 317 have no protrusion, but second electrodes 327 have protrusions 327*a* facing the first electrodes 317. In the seventh embodiment, a dielectric layer 357 surrounding the protrusions 327*a* also protrudes in the same direction as the protruding direction of the protrusions 327.

Figure 15:
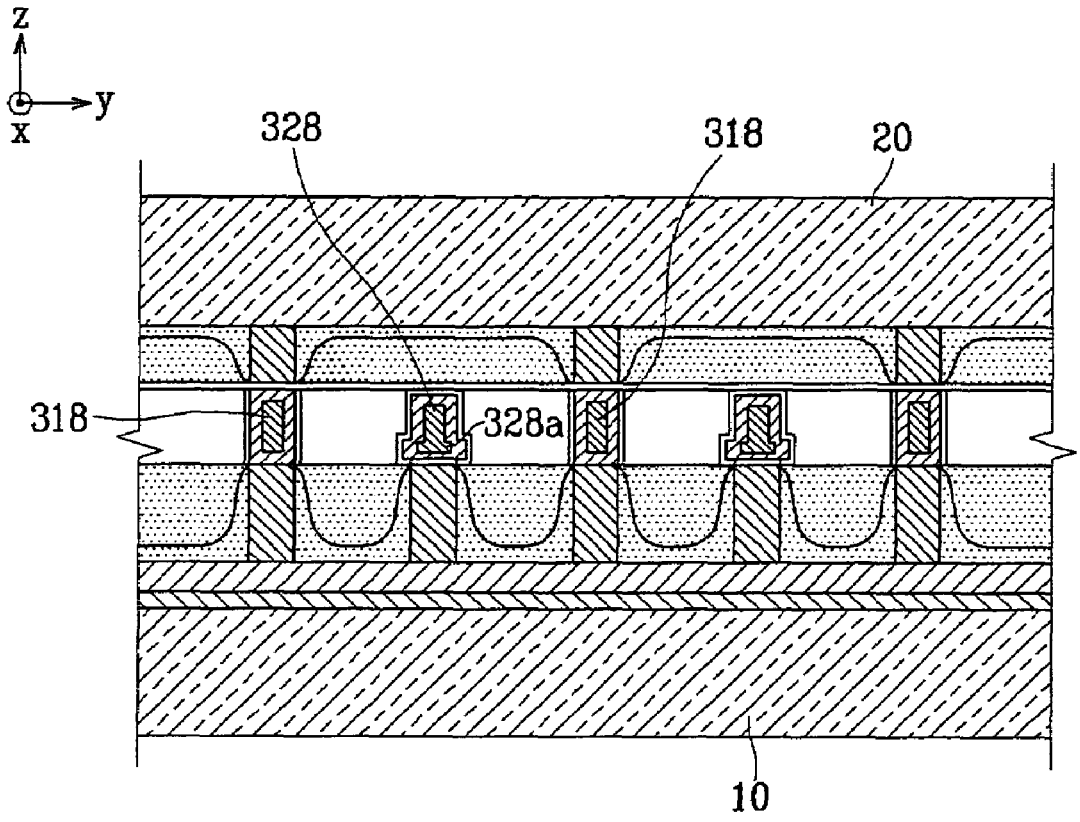
FIG. 15 is a partial plan view of a PDP according to an eighth embodiment of the present invention.

Turning now to FIG. 15, FIG. 15 is a partial plan view of a PDP according to the eighth embodiment of the present invention. In the eighth embodiment, first electrodes 318 have no protrusion, but second electrodes 328 have protrusions 328*a* facing the first electrodes 318. In the eighth embodiment, the protrusions 328*a* are located closer to the rear substrate 10 than in the seventh embodiment.

Figure 16:
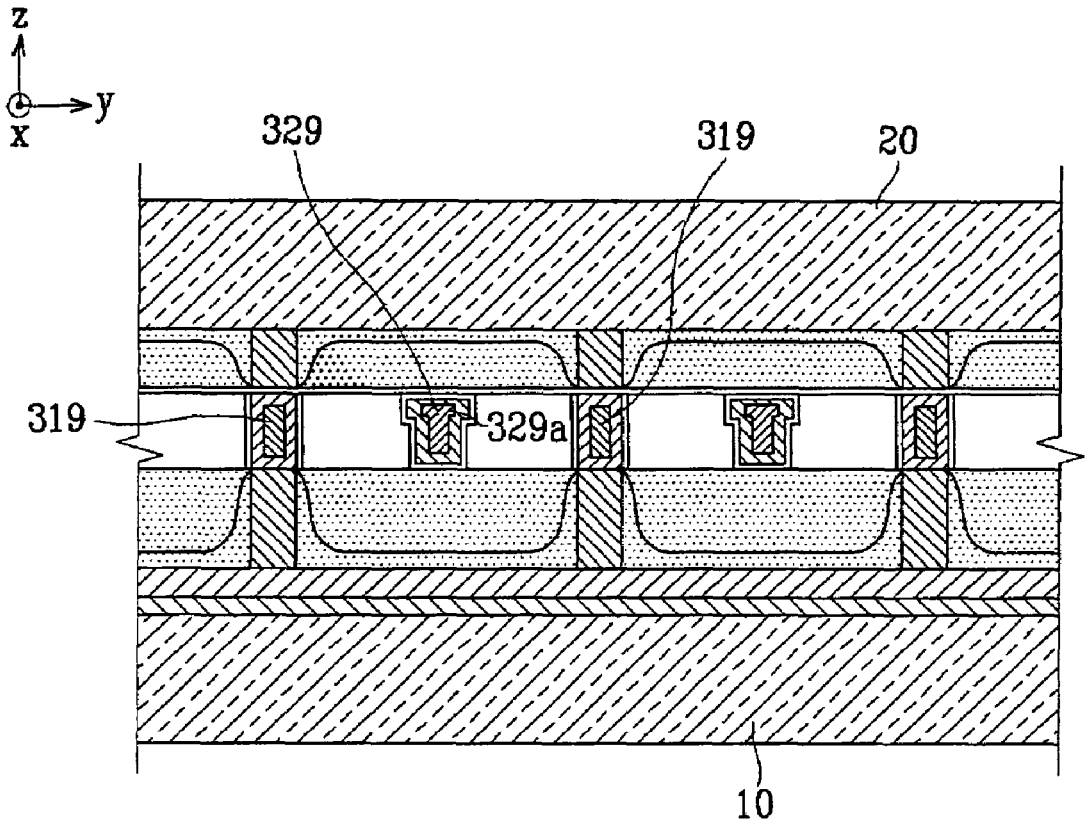
FIG. 16 is a partial plan view of a PDP according to a ninth embodiment of the present invention.

Turning now to FIG. 16, FIG. 16 is a partial plan view of a PDP according to the ninth embodiment of the present invention. In the ninth embodiment, first electrodes 319 have no protrusion, but second electrodes 329 have protrusions 329*a* facing the first electrodes 319. In the ninth embodiment, the protrusions 329*a* are located closer to the front substrate 20 than in the seventh embodiment. Also in the ninth embodiment, the auxiliary barrier rib element is not present.

In the PDPs of the present invention, since a sustain discharge is generated as a facing discharge, it is possible to decrease a discharge firing voltage. Also, since two sustain discharges are generated for one discharge cell, it is possible to increase a luminous efficiency. Since address electrodes each are made up of two address discharge generation portions having a large area and a connection portion connecting the two address discharge generation portions corresponding to the first and second electrodes, a large number of wall charges can be accumulated on the first and second electrodes, so that the address discharge can be more easily generated.

In the PDPs of the present invention, since the dielectric layers and transparent electrodes are not present on a front substrate, it is possible to reduce production cost of PDP and increase visible-light transmittance thereof. Since a non transparent MgO protective layer is used, it is possible to further lower a discharge firing voltage. As a result, it is possible to minimize loss of vacuum ultraviolet (VUV) light and improve a luminous efficiency. Since protrusions can be present in the sustain and/or scan electrodes, it is possible to further lower a sustain discharge voltage.

Although the exemplary embodiments and the modified examples of the present invention have been described, the present invention is not limited to the embodiments and examples, but can be modified in various forms without departing from the scope of the appended claims, the detailed description, and the accompanying drawings of the present invention. Therefore, it is natural that such modifications belong to the scope of the present invention.

What is claimed is:

1. A plasma display panel, comprising:

a first and a second substrate facing each other;

a plurality of address electrodes arranged on the first substrate and extending parallel to each other in a first direction;

a plurality of barrier ribs having a grid shape and comprising first and second barrier rib elements arranged between the first substrate and the second substrate to partition and define a plurality of discharge cells, the first barrier rib elements extending in the first direction and the second barrier rib elements extending in a second direction that intersects with the first direction;

phosphor layers arranged in the discharge cells;

a plurality of first electrodes arranged between the first substrate and the second substrate and adjacent to the second barrier rib elements and extending in the second direction, the first electrodes having a striped shape; and a plurality of second electrodes arranged between adjacent first electrodes and passing through internal spaces of the discharge cells in the second direction, each of the second electrodes being arranged between a pair of consecutively arranged second barrier ribs, the second electrodes having a striped shape and produce a sustain discharge together with the first electrodes.

2. The plasma display panel of claim 1, wherein the first electrodes are surrounded by a dielectric layer.

3. The plasma display panel of claim 1, wherein transverse cross sections of the first electrodes and the second barrier rib elements have substantially the same central lines.

4. The plasma display panel of claim 1, wherein heights of transverse cross sections of the first electrodes in a direction perpendicular to the substrates are larger than widths thereof in a direction parallel to the substrates.

5. The plasma display panel of claim 1, further comprising a protective layer arranged on at least a side wall of the first electrodes facing the internal spaces of the discharge cells.

6. The plasma display panel of claim 5, wherein the protective layer is not transparent to visible light.

7. A plasma display panel, comprising:

a first and a second substrate facing each other;

a plurality of address electrodes arranged on the first substrate and extending parallel to each other in a first direction;

a plurality of barrier ribs comprising first and second barrier rib elements arranged between the first substrate and the second substrate to partition a plurality of discharge cells, the first barrier rib elements extending in the first direction and the second barrier rib elements extending in a second direction that intersects with the first direction;

phosphor layers arranged in the discharge cells;

a plurality of first electrodes arranged between the first substrate and the second substrate and adjacent to the second barrier rib elements and extending in the second direction, the second electrodes being surrounded by a dielectric layer; and a plurality of second electrodes arranged between adjacent first electrodes and passing through internal spaces of the discharge cells in the second direction, wherein a thickness of the dielectric layer arranged on a bottom surface of each of the second electrodes facing the first substrate is larger than a thickness of the dielectric layer arranged on a side wall of each of the second electrodes facing the first electrodes.

8. The plasma display panel of claim 1, wherein heights of transverse cross sections of the second electrodes in a direction perpendicular to the substrates are larger than widths thereof in a direction parallel to the substrates.

9. The plasma display panel of claim 1, further comprising a protective layer arranged to surround at least a surface of the second electrodes exposed to an internal space of the discharge cells.

10. The plasma display panel of claim 9, wherein the protective layer is not transparent to visible light.

11. The plasma display panel of claim 1, wherein the second electrodes are arranged to pass through the first barrier rib elements.

12. The plasma display panel of claim 1, wherein the first and second barrier rib elements are arranged to protrude from the first substrate toward the second substrate.

13. The plasma display panel of claim 12, further comprising a plurality of third barrier rib elements having a shape corresponding to the first barrier rib elements, wherein the third barrier rib elements are arranged to protrude from the second substrate toward the first substrate.

14. The plasma display panel of claim 12, further comprising a plurality of fourth barrier rib elements having a shape corresponding to the second barrier rib elements, wherein the fourth barrier rib elements are arranged to protrude from the second substrate toward the first substrate.

15. The plasma display panel of claim 14, wherein the first electrodes are arranged between the second and fourth barrier rib elements.

16. The plasma display panel of claim 13, wherein the second electrodes are arranged between the first and third barrier rib elements.

17. The plasma display panel of claim 12, further comprising:

a plurality of third barrier rib elements having a shape corresponding to the first barrier rib elements, wherein the third barrier rib elements are arranged to protrude from the second substrate toward the first substrate; and a plurality of fourth barrier rib elements having a shape corresponding to the second barrier rib elements, wherein the fourth barrier rib elements are arranged to protrude from the second substrate toward the first substrate, wherein phosphor layers are arranged on regions of the second substrate defined by the third and fourth barrier rib elements.

18. The plasma display panel of claim 1 , wherein the address electrodes comprise address discharge generation portions arranged between the first and second electrodes and connection portions electrically connecting the address discharge generation portions.

19. The plasma display panel of claim 18, wherein widths of the connection portions in a direction intersecting the address electrodes are smaller than widths of the address discharge generation portions in the direction intersecting the address electrodes.

20. The plasma display panel of claim 18, wherein two of the address discharge generation portions are arranged in each of the discharge cells.

21. The plasma display panel of claim 18, wherein the address discharge generation portions have a rectangular shape corresponding to a space defined by the first and second electrodes.

22. The plasma display panel of claim 18, wherein first gaps are arranged between the address discharge generation portions and the first electrodes, wherein second gaps are arranged between the address discharge generation portions and the second electrodes, and wherein the first gaps are larger than the second gaps.

23. The plasma display panel of claim 1, further comprising auxiliary barrier rib elements arranged between the adjacent second barrier rib elements and extending in a direction parallel to the second barrier rib elements, and wherein the second electrodes are arranged corresponding to the auxiliary barrier rib elements and extending in a same direction as the auxiliary barrier rib elements.

24. The plasma display panel of claim 23, wherein phosphor layers are arranged on side walls of the auxiliary barrier rib elements.

25. The plasma display panel of claim 23, wherein transverse cross sections of the second electrodes and the corresponding auxiliary barrier rib elements have substantially the same central lines.

26. The plasma display panel of claim 23, further comprising:

a plurality of third barrier rib elements arranged corresponding to the first barrier rib elements and protruding from the second substrate toward the first substrate; and a plurality of fourth barrier rib elements arranged corresponding to the second barrier rib elements and protruding from the second substrate toward the first substrate, wherein the first electrodes are arranged between the second and fourth barrier rib elements that face each other, and wherein the second electrodes are arranged between the auxiliary barrier rib elements and the third barrier rib elements that intersect each other.

27. The plasma display panel of claim 1, wherein protrusions are provided on at least one of the first and second electrodes in a facing direction of the first and second electrodes.

28. The plasma display panel of claim 27, wherein the protrusions are arranged on side walls of the first electrodes facing the second electrodes.

29. The plasma display panel of claim 28, wherein the protrusions are arranged at the central positions of transverse cross sections of the first electrodes between the first and the second substrates.

30. The plasma display panel of claim 28, wherein the first electrodes and the protrusions thereof are surrounded by a dielectric layer.

31. The plasma display panel of claim 27, wherein the protrusions, are arranged on side walls of the second electrodes facing the first electrodes.

32. The plasma display panel of claim 31, wherein the protrusions are arranged closer to one of the first substrate and the second substrate.

33. The plasma display panel of claim 31, wherein the protrusions are arranged at the central positions of transverse cross sections of the second electrodes in a direction perpendicular to the first and the second substrates.

34. The plasma display panel of claim 31, wherein the second electrodes and the protrusions thereof are surrounded by a dielectric layer.

35. The plasma display panel of claim 27, wherein the protrusions are arranged on side walls of the first electrodes facing the second electrodes, and wherein the second electrodes have protrusions protruding from the second electrodes toward the first electrodes.

36. The plasma display panel of claim 27, wherein transverse cross sections of the second electrodes have a rectangular shape, wherein heights of the transverse cross sections of the second electrodes in a direction perpendicular to the substrates are larger than widths thereof in a direction parallel to the substrates, and wherein the first electrodes have protrusions protruding from the first electrodes toward the second electrodes.

37. The plasma display panel of claim 27, wherein transverse cross sections of the first electrodes have a rectangular shape, wherein heights of the transverse cross sections of the first electrodes in a direction perpendicular to the substrates are larger than widths thereof in a direction parallel to the substrates, and wherein the second electrodes have protrusions protruding from the second electrodes toward the first electrodes.

38. The plasma display panel of claim 27, wherein transverse cross sections of the first electrodes have a rectangular shape, wherein heights of the transverse cross sections of the first electrodes in a direction perpendicular to the substrates are larger than widths thereof in a direction parallel to the substrates, wherein the second electrodes have protrusions protruding from the second electrodes toward the first electrodes, and wherein a dielectric layer surrounding the protrusions protrudes in the protruding direction of the protrusions of the second electrodes.

39. The plasma display panel of claim 27, wherein transverse cross sections of the first electrodes have a rectangular shape, wherein heights of the transverse cross sections of the first electrodes in a direction perpendicular to the substrates are larger than widths thereof in a direction parallel to the substrates, wherein the second electrodes have protrusions protruding from the second electrodes toward the first electrodes, and wherein the protrusions of the second electrodes are arranged on a portion of the second electrodes closest to the first substrate.

40. The plasma display panel of claim 27, wherein transverse cross sections of the first electrodes have a rectangular shape, wherein heights of the transverse cross sections in a direction perpendicular to the substrates are larger than widths thereof in a direction parallel to the substrates, wherein the second electrodes have protrusions protruding from the second electrodes toward the first electrodes, and wherein the protrusions of the second electrodes are arranged on a portion of the second electrodes closest to the second substrate.

41. The plasma display panel of claim 7, comprised of:

the first and second barrier rib elements are arranged to protrude from the first substrate toward the second substrate;

the address electrodes comprise address discharge generation portions arranged between the first and second electrodes and connection portions electrically connecting the address discharge generation portions;

a plurality of auxiliary barrier rib elements arranged between the adjacent second barrier rib elements and extending in a direction parallel to the second barrier rib elements, and wherein the second electrodes are arranged corresponding to the auxiliary barrier rib elements and extending in a same direction as the auxiliary barrier rib elements; and protrusions being arranged at the central positions of transverse cross sections of the first electrodes between the first and the second substrates, the first electrodes and the protrusions thereof are surrounded by a dielectric layer.

42. The plasma display panel of claim 1, each second electrode dividing ones of the plurality of discharge cells in half.

43. The plasma display panel of claim 1 , further comprising a plurality of third and fourth barrier rib elements arranged between the first substrate and the second substrate to further partition and define the plurality of discharge cells, the third barrier rib elements extending in the first direction and the second barrier rib elements extending in a second direction that intersects with the first direction, the third and the fourth barrier ribs together having a grid shape.

44. The plasma display panel of claim 43, the third and the fourth barrier ribs being arranged on the second substrate and the first and second barrier ribs being arranged on the first substrate, the first and the second electrodes being arranged on a layer between the combined third and fourth barrier ribs and the combined first and second barrier ribs.

* * * * *